United States Patent [19]

Snoble

[11] 4,431,493

[45] Feb. 14, 1984

[54] ELECTROCHEMICAL PREPARATION OF ETHER KETONES FROM (POLY)PROPYLENE GLYCOL MONOETHERS

[75] Inventor: Karel A. J. Snoble, Midland, Mich.

[73] Assignee: The Dow Chemical Company, Midland, Mich.

[21] Appl. No.: 423,876

[22] Filed: Sep. 27, 1982

[51] Int. Cl.[3] ..... C25B 3/02

[52] U.S. Cl. ..... 204/79; 204/59 R

[58] Field of Search ..... 204/59 R, 78, 79

[56] References Cited

U.S. PATENT DOCUMENTS 4,093,661 6/1978 Trecker et al. ..... 568/319

FOREIGN PATENT DOCUMENTS 1051614 12/1963 United Kingdom .
1541105 2/1979 United Kingdom .

OTHER PUBLICATIONS

Amjad et al., "The Oxidation of Alcohols at a Nickel Anode in Alkaline t-Butanol/Water Mixtures", *Electrochem. Sci. & Tech.*, 124, 203 (1977).

Fleischmann, Korinek and Pletcher, "The Oxidation of Organic Compounds at a Nickel Anode in Alkaline Solution", *J. Electroanal. Chem.*, 31, 39–49 (1971).

Guzman, Vilche and Arvia, "Nonequilibrium Effects in the Nickel Hydroxide Electrode", *Journal of Applied Electrochemistry*, 9, 183–189 (1979).

Kaulen and Schafer, "Oxidation of Primary Alcohols to Carboxylic Acids at the Nickel Hydroxide Electrode", *Synthesis*, 513–516 (Jul., 1979).

Nakagawa, Konaka and Sugita, "Application and Mechanism of Oxidation with Nickel Peroxide", *Annual Report of Schionogi Reserach Laboratory*, No. 19 (1969).

Sidney Ross, John E. Barry, Manuel Finkelstein and Eric J. Rudd, "Anodic Oxidations, IX, Anodic Oxidation of 2-Methoxyethanol", *JACS*, 95:7, 2193 (Apr. 4, 1973).

Vertes, Horanyi and Nagy, "A New Method for the Electrochemical Oxidation of Alcohols", *Tetrahedron*, 28, 37–42.

Vertes, Horanyi and Nagy, "Oxidation of the Nickel Hydroxide Electrode, I", *Acta Chimica Academiae Hungaricae, Tomus*, 67, (2), 145–156 (1971).

*Primary Examiner*—John F. Niebling
*Attorney, Agent, or Firm*—Normal L. Sims

[57] ABSTRACT

This invention is a method for preparing an ether ketone comprising electrolyzing a solution containing a (poly)propylene glycol monoether, hydroxyl ions and optionally water in an electrolytic cell having an anode at least partially coated with nickel peroxide, silver peroxide, cobalt peroxide or copper peroxide.

13 Claims, No Drawings

ELECTROCHEMICAL PREPARATION OF ETHER KETONES FROM (POLY)PROPYLENE GLYCOL MONOETHERS

BACKGROUND OF THE INVENTION

This invention relates to the preparation of ether ketones by electrolysis. More specifically, it relates to the oxidation of the hydroxyl moiety contained on a (poly)propylene glycol monoether by electrolysis to prepare an ether ketone.

Houben-Weyl, *Methoden der Organischen Chemie,* vol. 7/1, pp. 166 and 167, discloses that compounds which in addition to the primary alcohol group contain other groups in most cases, give only very moderate yields when dehydrogenated to the aldehydes. To avoid decomposition reactions, it is necessary to work either at the lowest feasible temperature or, as in the case of the dehydrogenation of tetrahydrofurylcarbinol to tetrahydrofuran-2-aldehyde, to work at a relatively high temperature, with minimum residence time over the catalyst. Thus, when preparing methoxyacetaldehyde, a hydrogen-treated copper oxide catalyst and a reaction temperature of 300° C. are employed. Ethoxyacetaldehyde and butoxyacetaldehyde can also be prepared by a similar method, but in these cases the yields are even worse.

An article in *Zh. Prikl. Khim.,* (Leningrad) 43 (1970), pp. 1132–1136 (English text, pp. 1137–1140), describes a reaction of methyl glycol with air over silver wire spirals as a catalyst, at from 380° C. to 578° C., with yields of from 24.3 to 58 percent, based on starting material. Similar reactions were carried out with butyl glycol at from 463° C. to 488° C. In both cases, reaction temperatures of from 465° C. to 475° C. are regarded as advantageous. A disadvantage of these processes is that notwithstanding the use of reduced pressure, and of equal amounts of nitrogen and air, the maximum achievable yield is only 58 percent.

It is also known (Houben-Weyl, loc. cit., vol. 7/2a, pp. 699–776) that secondary alcohols can be converted to ketones by catalytic dehydrogenation or by oxidation with air. The catalysts generally proposed are both hydrogenation catalysts and dehydrogenation catalysts, especially the above catalysts for the synthesis of aldehydes (loc. cit., p. 700). In general, the dehydrogenation is carried out in the gas phase at from 180° C. to 400° C., in the main at from 200° C. to 250° C. In the synthesis of 1-methoxy-2-oxo-propane, oxidation with chromic acid/sulfuric acid/water mixtures gives a yield of only 29 percent (Houben-Weyl, loc. cit., vol. 7/2a, pp. 722–724).

Dudeck et al., U.S. Pat. No. 4,233,246, Nov. 11, 1980, teach that aliphatic hydroxy carbonyl compounds etherified with aliphatic groups are prepared by oxidizing hydroxy alcohols in the presence of a metal catalyst consisting of one or more layers containing components of silver and copper, with or without added copper/tin/phosphorus or silver alone. The oxidation takes place at temperatures from 450° C. to 700° C.

Wymore, U.S. Pat. No. 4,218,401, Aug. 19, 1980, teaches that primary and secondary alcohols, including alkoxy alkanols, can be oxydehydrogenated to aldehydes and ketones by contacting their vapors mixed with an oxygen-containing gas over a catalyst of rhodium, palladium, platinum, iridium or osmium on a support. The reaction is run at temperatures from 225° C. to 600° C.

Several patents teach the preparation of alkoxy ketones by high temperature dehydrogenation of alkoxy alkanols in the presence of different catalysts. Gremmelmaier, U.S. Pat. No. 4,141,919, Feb. 27, 1979, teaches the use of a copper-containing catalyst activated at high temperatures with hydrogen, wherein the reaction is run at temperatures from 90° C. to 450° C. Friedli, U.S. Pat. No. 3,462,495, Aug. 19, 1969, teaches the use of a calcium nickel phosphate catalyst at a temperature of 350° C. to 450° C.

Kaulen and Schafer, "Oxidation of Primary Alcohols to Carboxylic Acids at the Nickel Hydroxide Electrode", *Synthesis,* 513–516 (July, 1979), disclose that primary alcohols can be oxidized to carboxylic acids by electrolysis in a water and sodium hydroxide solution with a nickel hydroxide anode and a steel cathode. Vertes et al., "A New Method for the Electrochemical Oxidation of Alcohols", *Tetrahedron,* 28, 37–42 (1972), teach that primary alcohols, such as ethanol and benzyl alcohol, can be oxidized to aldehydes. Such oxidation takes place by electrolysis of a solution containing the primary alcohol and potassium hydroxide using a nickel hydroxide coated electrode.

Fleischman et al., "The Oxidation of Organic Compounds at a Nickel Anode in Alkaline Solution", *J. Electroanal. Chem.,* 31, 39–49 (1971), teach that primary and secondary alcohols can be electrolyzed to prepare carboxylic acids and ketones using a nickel electrode. It is suggested therein that nickel hydroxide is prepared at the electrode. It is further suggested that such compound then oxidizes the primary of secondary alcohol. The possible preparation of nickel peroxide on the electrode is suggested.

British Pat. No. 1,051,614 teaches that a secondary alcohol can be oxidized to a ketone by electrolysis using a nickel electrode.

Ross et al., "Anodic Oxidation. IX. Anodic Oxidation of 2-Methoxyethanol", *J.A.C.S.,* 95(7), 2193 (April, 1973), teach that electrolysis of 2-methoxyethanol in the presence of fluoroborate electrolytes results in the oxidation of the ether functionality rather than the alcohol functionality A process for the preparation of ether ketones from (poly)propylene glycol monoethers wherein the hydroxy group is selectively oxidized without the oxidation of the ether functionality is desirable. It is also desirable to do such process at low temperatures.

SUMMARY OF THE INVENTION

This invention is a method for preparing an ether ketone comprising electrolyzing a solution containing a (poly)propylene glycol monoether, hydroxyl ions and optionally water in an electrolytic cell having an anode at least partially coated with nickel peroxide, silver peroxide, cobalt peroxide or copper peroxide.

The ether ketones prepared by this process are valuable starting materials for the preparation of dyes, pesticides, plastics and scents.

DETAILED DESCRIPTION OF THE INVENTION

The invention is a process for the selective oxidation of the hydroxyl moiety of a (poly)propylene glycol monoether by electrolysis. The catalyst used promotes this selectivity and can be cobalt peroxide, copper peroxide, nickel peroxide or silver peroxide. The preferred catalyst is nickel peroxide.

The catalyst is electroplated on the anode prior to the electrolytic oxidation of the (poly)alkylene glycol monoether.

This process is run at relatively low temperatures. Suitable temperatures are between about 0° C. and about 80° C., preferably between about 5° C. and about 10° C. Below about 0° C. the reaction rates are too low because the electrolysis solution is too viscous.

The (poly)propylene glycol monoethers used in this invention include those represented by the formula $$R-(OCH_2\overset{\overset{\displaystyle CH_3}{|}}{C}H)_n-OH$$

wherein

R is alkyl, aryl or aryl-substituted alkyl; and n is an integer between 1 and 20, inclusive.

R is preferably $C_{1-3}$ alkyl, and most preferably methyl. n is preferably an integer between 1 and 5, inclusive, and most preferably 1.

The products of this process are ether ketones which include those represented by the formula $$R(OCH_2\overset{\overset{\displaystyle CH_3}{|}}{C}H)_{n-1}-OCH_2\overset{\overset{\displaystyle O}{\|}}{C}CH_3$$

wherein R and n are as defined above. In this process, there are no by-products substantially formed except $H_2$ gas. The ether functionality is minimally oxidized by this process.

The electrolysis takes place in a solution which comprises the (poly)propylene glycol monoether, an electrolyte and may optionally include water. The electrolyte can be any hydroxide-containing or hydroxide-producing compound soluble in the electrolysis solution. It is advantageous to add water to the electrolysis solution as the presence of water increases the rate of reaction.

Preferably, the electrolysis solution contains between about 1 and 99.5 percent by weight of the (poly)propylene glycol monoether and between about 0 and 95 percent by weight of water. Most preferably, the electrolysis solution contains between about 65 and 95 percent by weight of the (poly)propylene glycol monoether and between about 5 and 35 percent by weight of water. The electrolyte concentration can be between about 0.01 and 1.2 molar, preferably 0.1 to 0.3 molar. Below 0.01 molar the reaction rate is too slow. Above 1.2 molar the electrolyte concentration is uneconomical.

The electrolysis solution may further include a solvent. Suitable solvents include tertiary alcohols, such as t-butyl alcohol.

The electrolysis can take place in a one-, two- or multi-compartment cell. A one-compartment cell is preferred because such a cell is more energy efficient. "One-compartment cell" means herein that there is no membrane between the anode and cathode.

The anode can be prepared from any suitable material stable at reaction conditions. Examples of suitable anodes include nickel, steel and platinum. The cathode can be prepared from any suitable material stable at reaction conditions. Examples of suitable materials for cathodes include stainless steel, carbon and platinum.

Such variables as voltage, potential and current density are dependent upon several conditions such as distance between electrodes, resistance, electrolyte concentration, temperature, the amount of (poly)propylene glycol monoether present and the amount of water present.

The choice of values for these variables is dependent upon such conditions. The specification of values for every imaginable set of conditions would be impossible. Those skilled in the art can determine such values once the conditions have been determined.

It has been found that for a small experimental one-compartment cell of the type hereinafter described in the examples, the following values are suitable for the electrolysis. A suitable voltage has been found to be between about −0.1 and +0.5 volts.

The catalyst can be electroplated onto the electrode by methods well-known in the art. See Vertes, Horanyi and Nagy, "Oxidation of the Nickel Hydroxide Electrode I", *Acta Chimica Scientiarum Hungaricae, Tomas,* 67(2), 145–156 (1971) (incorporated herein by reference) and Kaulen and Shafer, "Oxidation of Primary Alcohols to Carboxylic Acids at the Nickel Hydroxide Electrode", *Synthesis Communications,* 513–516 (July 1979) (incorporated herein by reference). The catalyst is electroplated on the anode prior to placing the electrode in the electrolysis solution. The electroplating is done by placing the anode and a suitable cathode in an electrolytic cell. The cell contains a solution comprising: a salt of the silver, cobalt, copper or nickel; an alkaline metal or alkaline earth metal acetate; and an alkaline metal or alkaline earth metal hydroxide, for example, 0.1 N nickel sulfate, 0.1 N sodium acetate and 0.005 N sodium hydroxide. The solution is electrolyzed by treatment with a low frequency alternating current, using a current density of between about 10 ma/cm$^2$ and 1 ma/cm$^2$. During this electrolysis, the potential differences should be high enough to plate nickel, cobalt, copper or silver peroxide onto the anode and not so high as to electrolyze large amounts of water. A potential difference of 0.7 volts is useful in the small one-compartment cell described below. It is believed that alternate switching of the polarity between the cathode and anode effectively cleans the anode so that the metal peroxide electroplated thereon does not plate off when in solution. Thereafter, the anode is rinsed with deionized water. The anode is immersed in a 2 percent sodium hydroxide along with a suitable cathode, where the solution is electrolyzed by adjusting the potential difference to allow an initial current density of 30 ma/cm$^2$. The current is allowed to decay for between about 20 and 30 minutes. The anode is removed and rinsed with deionized water. Thereafter the complete process is repeated once or twice more. This process for the preparation of the electrode is usually done at a temperature between about 10° C. and 30° C.

The anode which has a metal peroxide electroplated thereon can be used immediately or stored in organic-free water for short times.

This process has demonstrated current efficiency of greater than 50 percent.

SPECIFIC EMBODIMENTS

The following examples are included for illustrative purposes and are not intended to limit the scope of the invention or claims.

EXAMPLE 1

Electrode Preparation

A nickel Exmet anode (2 cm high, 3.5 cm dia.) and a stainless steel mesh cathode (2 cm high, 6 cm long, curved) were placed in a mechanically stirred, thermostated cell at 20° C. and the nickel peroxide coating formed on the nickel Exmet (from a $NiSO_4$, NaOAc, NaOH solution) by switching the polarity of a 0.7 v potential difference between anode and cathode for 30 seconds rinsing with deionized water, then immersing in 2 percent NaOH and adjusting the potential difference to allow an initial 30 ma current to flow, allowing the current to decay for about 20–30 minutes, rinsing with deionized water, then repeating the procedure twice more to obtain a nickel anode with a black coating of nickel peroxide.

EXAMPLE 2

Electrolysis of Dowanol PM (Propylene Glycol, Monomethyl Ether)

To a one-compartment cell containing the electrode prepared in Example 1 at about 7° C., was added 32.1 g of solution of 22.51 g DOWANOL® PM (trademark of The Dow Chemical Company) (1-methoxy-2-propanol), 1.32 g KOH and 9.84 g deionized water. The potentiostated voltage is increased to 0.3 v (2.25 v cell) and 160 ma/cm$^2$ current and run until the current has fallen to 67 ma/cm$^2$ (2.45 v cell), resulting in 9330 coulombs passed. This is 20.3 percent of the maximum coulombs required for 100 percent conversion. Via gas/liquid phase chromatographic analysis, 11.6 percent of 1-methoxy-2-propanone is present, for a current efficiency of about 57 percent.

What is claimed is:

1. A method for preparing an ether ketone comprising electrolyzing a solution containing a (poly)propylene glycol monoether, hydroxyl ions and optionally water in an electrolytic cell having an anode at least partially coated with nickel peroxide, silver peroxide, cobalt peroxide or copper peroxide.

2. The method of claim 1 wherein the (poly)propylene glycol monoether is represented by the formula $$R-(OCH_2\overset{\overset{\displaystyle CH_3}{|}}{C}H)_n-OH$$

wherein

R is alkyl, aryl or aryl-substituted alkyl; and n is an integer from 1 to 20.

3. The process of claim 2 wherein R is a $C_{1-3}$ alkyl group.

4. The process of claim 2 wherein R is methyl.

5. The process of claim 2 wherein n is an integer from 1 to 5.

6. The process of claim 2 wherein n is 1.

7. The process of claim 1 wherein a one-compartment electrolytic cell is used for the electrolysis.

8. The process of claim 1 wherein the anode is at least partially coated with nickel peroxide.

9. The process of claim 1 wherein the temperature is between about 0° C. and about 80° C.

10. The process of claim 1 wherein the temperature is between about 5° C. and about 10° C.

11. The process of claim 1 wherein the current efficiency is greater than 50 percent.

12. The process of claim 1 wherein the solution comprises between about 1 and 99.5 percent by weight of a (poly)propylene glycol monoether, between about 0 and 95 percent water, and between about 0.01 and 1.2 moles/liter of an electrolyte.

13. An electrolytic solution comprising between about 1 and 99.5 percent by weight of a (poly)propylene glycol monoether, between about 0 and 95 percent water, and between about 0.01 and 1.2 moles/liter of an electrolyte.

* * * * *